US011739543B2

(12) United States Patent
Ashton et al.

(10) Patent No.: US 11,739,543 B2
(45) Date of Patent: Aug. 29, 2023

(54) CONCRETE FINISHING ASSEMBLY

(71) Applicants: John M. Ashton, Mukilteo, WA (US); Sarah A. Noet, Mukilteo, WA (US)

(72) Inventors: John M. Ashton, Mukilteo, WA (US); Sarah A. Noet, Mukilteo, WA (US)

( * ) Notice: Subject to any disclaimer, the term of this patent is extended or adjusted under 35 U.S.C. 154(b) by 47 days.

(21) Appl. No.: 17/405,676

(22) Filed: Aug. 18, 2021

(65) Prior Publication Data

US 2022/0056712 A1 Feb. 24, 2022

Related U.S. Application Data

(60) Provisional application No. 63/067,364, filed on Aug. 19, 2020.

(51) Int. Cl.
*E04F 21/24* (2006.01)

(52) U.S. Cl.
CPC ..... *E04F 21/245* (2013.01)

(58) Field of Classification Search
CPC ..... E04F 21/245; E04F 21/247; E04F 21/248
USPC ..... 404/112
See application file for complete search history.

(56) References Cited

U.S. PATENT DOCUMENTS

| | | | | |
|---|---|---|---|---|
| 2,836,056 | A * | 5/1958 | Drummond | E04F 21/08 404/112 |
| 2,860,506 | A | 11/1958 | Drummond | |
| 3,591,884 | A * | 7/1971 | Grueb | E04F 21/248 264/261 |
| 5,042,208 | A | 8/1991 | Richardson | |
| 5,882,249 | A | 3/1999 | Ferland | |
| 7,104,725 | B1 | 9/2006 | Kipp et al. | |
| 7,144,194 | B2 | 12/2006 | Kipp, Jr. | |
| 7,399,140 | B2 | 7/2008 | Barcenas | |
| 8,757,925 | B2 | 6/2014 | Banchio | |
| 2005/0238429 | A1 * | 10/2005 | Kipp, Jr. | E04F 21/248 404/112 |
| 2006/0083589 | A1 | 4/2006 | McClain | |

* cited by examiner

*Primary Examiner* — Gary S Hartmann
(74) *Attorney, Agent, or Firm* — Bold IP, PLLC

(57) ABSTRACT

A concrete smoothing assembly having a plurality of blades extending radially from a central hub. The central hub is attachable to a rotating power tool to effectively rotate the blades about a vertical axis. The blades are angled at an offset angle with respect to a horizontal axis, each with a lower working edge adapted to sweep imperfections from a surface of partially dried concrete.

11 Claims, 7 Drawing Sheets

CONCRETE FINISHING ASSEMBLY

CROSS-REFERENCE TO RELATED APPLICATIONS

This application claims priority to U.S. Provisional Application No. 63/067,364 filed Aug. 19, 2020, the entire contents of which are hereby fully incorporated herein by reference for all purposes.

FIELD OF THE INVENTION

This invention relates to tools and tool accessories, including a power tool accessory for smoothing concrete.

BACKGROUND

As is known in the art, once cement has been poured into an area to form a concrete slab, the cement will cure over time and become hardened. During this process, it is typically preferable to smooth the surface of the partially dried concrete to remove unwanted imperfections that may be on the concrete's top surface. This procedure is often referred to as "finishing" the concrete.

This exercise is typically performed using a hand trowel during which the user manually sweeps the trowel over the surface of the concrete to smooth away unwanted marks, lines, scratches, particles, or any other problematic surface issues on the concrete. However, this procedure is very laborious and time consuming when large areas of concrete require finishing.

Accordingly, there is a need for a power tool accessory that may be used to finish concrete while reducing the amount of time and human exertion required.

SUMMARY

According to one aspect, one or more embodiments are provided below for a concrete smoothing assembly adapted to be coupled with a rotating power tool, the assembly comprising a central hub adapted to be coupled to the rotating power tool and including at least two outward extending arms, a first blade attached to a first of the at least two outward extending arms, the first blade including a first blade distal portion and a first blade proximal portion, the first blade proximal portion including a first blade foot portion and a first blade offset portion, and a second blade attached to a second of the at least two outward extending arms, the second blade including a second blade distal portion and a second blade proximal portion, the second blade proximal portion including a second blade foot portion and a second blade offset portion, wherein a portion of the first blade foot portion overlaps a portion of the second blade offset portion.

In another embodiment, the concrete finishing assembly further comprises a third blade attached to a third of the at least two outward extending arms, the third blade including a third blade distal portion and a third blade proximal portion, the third blade proximal portion including a third blade foot portion and a third blade offset portion, and a fourth blade attached to a fourth of the at least two outward extending arms, the fourth blade including a fourth blade distal portion and a fourth blade proximal portion, the fourth blade proximal portion including a fourth blade foot portion and a fourth blade offset portion, wherein a portion of the second blade foot portion overlaps a portion of the third blade offset portion, a portion of the third blade foot portion overlaps a portion of the fourth blade offset portion, and a portion of the fourth blade foot portion overlaps a portion of the first blade offset portion.

In another embodiment, at least one of the at least two outward extending arms includes a top side and a bottom side, and the bottom side includes a slanted notch, wherein at least one of the first and second blades is attached to the slanted notch.

In another embodiment, the at least one of the at least two outward extending arms includes a left side and a right side, and the slanted notch extends from the right side to the left side.

In another embodiment, the slanted notch extends at an angle of 10°-20° with respect to a horizontal axis.

In another embodiment, at least one of the first blade and the second blade includes a left side and a right side, and a bottom side extending between the left side and the right side at an angle of 10°-20° with respect to a horizontal axis In another embodiment, the concrete finishing assembly further comprises a pin coupled to a top of the central hub, a portion of the pin extending upward and away from the central hub and perpendicular to the at least two outward extending arms, the pin adapted to be coupled to a rotating power tool.

In another embodiment, the first blade foot portion includes a rearmost proximal portion of the first blade proximal portion.

In another embodiment, the first blade foot portion and the first blade offset portion are joined by a concave curvature, and/or the second blade foot portion and the second blade offset portion are joined by a concave curvature.

In another embodiment, the first blade distal portion includes a convex curvature defining a first blade working edge, and/or the second blade distal portion includes a convex curvature defining a second blade working edge.

In another embodiment, the first working edge and/or the second working edge is sharpened.

According to another aspect, one or more embodiments are provided below for a concrete smoothing assembly adapted to be coupled to a rotating power tool, the assembly comprising a central hub adapted to be coupled to the rotating power tool, a first blade including a first blade distal portion and a first blade proximal portion, the first blade proximal portion coupled to the central hub and including a first blade foot portion and a first blade offset portion; and a second blade including a second blade distal portion and a second blade proximal portion, the second blade proximal portion coupled to the central hub and including a second blade foot portion and a second blade offset portion, wherein a portion of the first blade foot portion overlaps a portion of the second blade offset portion.

In another embodiment, the concrete smoothing assembly further comprises a third blade including a third blade distal portion and a third blade proximal portion, the third blade proximal portion coupled to the central hub and including a third blade foot portion and a third blade offset portion, and a fourth blade including a fourth blade distal portion and a fourth blade proximal portion, the fourth blade proximal portion coupled to the central hub and including a fourth blade foot portion and a fourth blade offset portion, wherein a portion of the second blade foot portion overlaps a portion of the third blade offset portion, a portion of the third blade foot portion overlaps a portion of the fourth blade offset portion, and a portion of the fourth blade foot portion overlaps a portion of the first blade offset portion.

In another embodiment, at least one of the first blade and the second blade includes a left side and a right side, and a bottom side extending between the left side and the right side at an angle of 10°-20° with respect to a horizontal axis.

In another embodiment, the concrete smoothing assembly further comprises a pin coupled to a top of the central hub, a portion of the pin extending upward and away from the central hub and adapted to be coupled to a rotating power tool.

In another embodiment, the first blade foot portion includes a rearmost proximal portion of the first blade proximal portion.

In another embodiment, the first blade foot portion and the first blade offset portion are joined by a concave curvature, and/or the second blade foot portion and the second blade offset portion are joined by a concave curvature.

In another embodiment, the first blade distal portion includes a convex curvature defining a first blade working edge, and/or the second blade distal portion includes a convex curvature defining a second blade working edge.

In another embodiment, the first working edge and/or the second working edge is sharpened.

In another embodiment, the first blade and/or the second blade extend radially from the central hub.

Other aspects and advantages of the invention will be apparent from the following description and the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the assembly according to exemplary embodiments hereof includes a power tool accessory adapted to smooth or otherwise "finish" the top surface of partially hardened concrete. In some embodiments, the assembly includes one or more radial blades extending from a central hub. The hub is coupled with a rotating power tool (e.g., a power drill) adapted to rotate thereby spinning the radial blades. The blades are adapted to engage the concrete's surface in a sweeping motion, thereby smoothing away marks and other rough elements on the concrete's surface.

Figure 1:
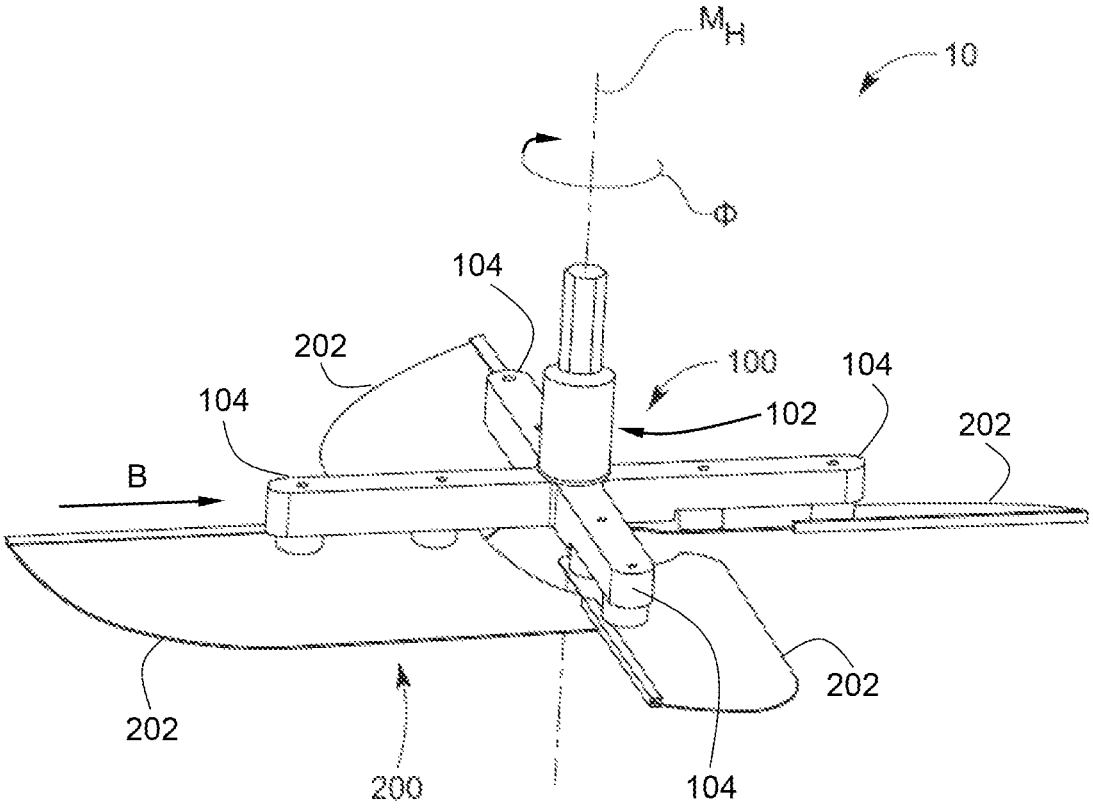
FIG. 1 shows a schematic of a concrete finishing assembly according to exemplary embodiments hereof.
Figure 2:
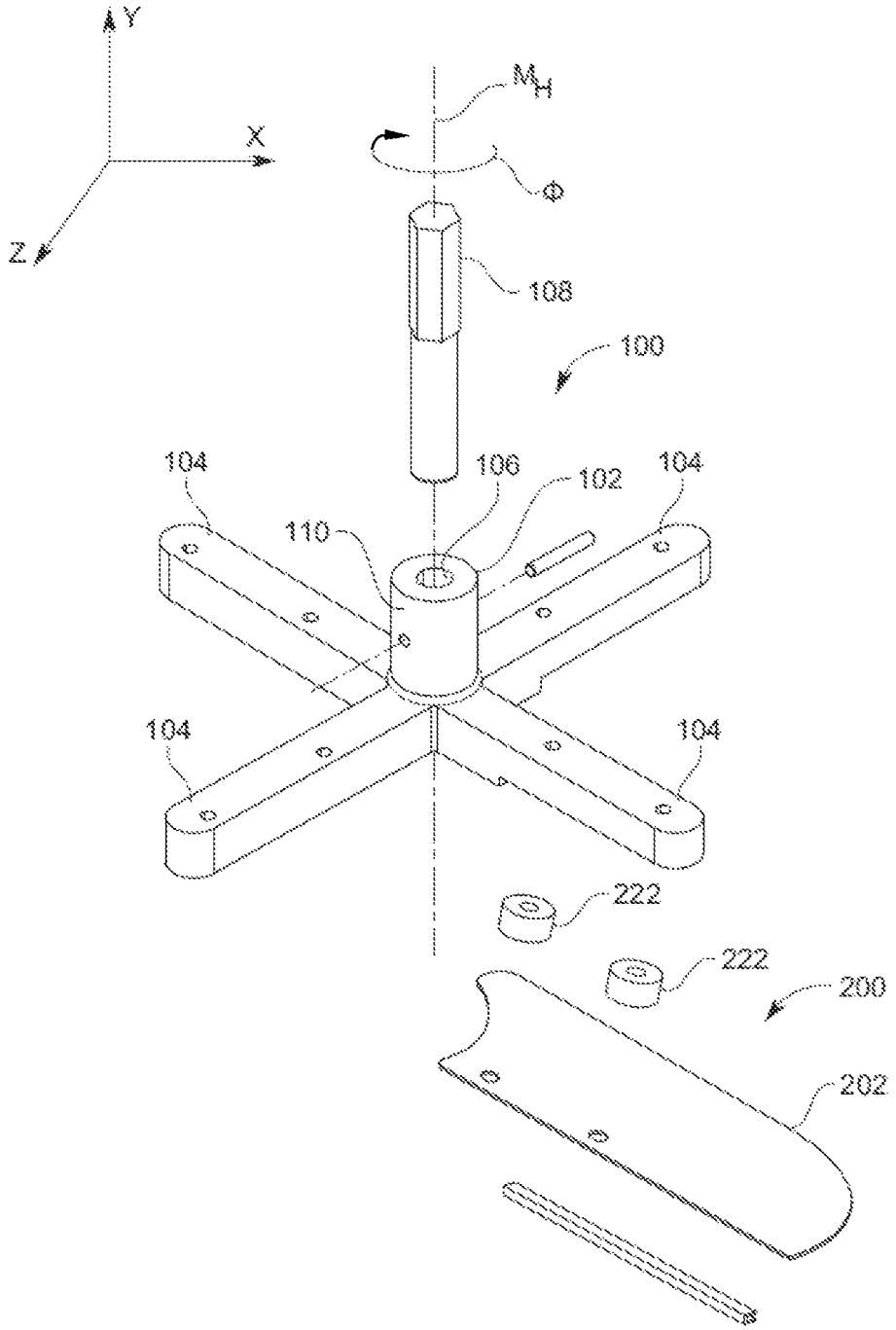
FIG. 2 shows an exploded view of the concrete finishing assembly of FIG. 1 according to exemplary embodiments hereof.

In one exemplary embodiment hereof, as shown in FIGS. 1 and 2, the concrete finishing assembly 10 (also referred to as a concrete smoothing assembly 10) includes a central hub assembly 100, and a blade assembly 200. FIG. 1 shows a schematic drawing of the concrete finishing assembly 10, and FIG. 2 shows an exploded view of the same. In general, the blade assembly 200 includes one or more radial blades coupled with and extending outward from the central hub assembly 100. The hub assembly 100 may be removably attached to a separate tool (e.g., a power drill, not shown) that may rotate the hub 100 (a.k.a central hub assembly), thereby causing the blade assembly 200 also to rotate. Accordingly, the finishing assembly 10 may be regarded as a removable accessory to the separate tool (the power drill) for its application. However, it also is understood that the finishing assembly 10 may be integrated into a rotating power tool as a permanent fixture.

For the purposes of this specification, the concrete finishing assembly 10 will be described primarily with use with a power drill. It is understood however that the finishing assembly 10 may be used with other types of tools (manual and/or powered), and that the scope of the finishing assembly 10 is not limited in any way by the type of tools that it may be used with. It is preferable that the power tools may be capable of rotating in order to rotate the assembly 10.

In use, a user of the concrete finishing assembly 10 may engage the rotating blade assembly 200 with the top surface of an area of partially hardened concrete area so that the sweeping motion of the blade assembly 200 may smooth imperfections from the concrete's surface.

Further details of the concrete finishing assembly 10, the central hub assembly 100, and the blade assembly 200 will be described below in relation to FIGS. 1-7.

Hub Assembly 100

In one exemplary embodiment hereof as shown in FIGS. 1-2, the hub assembly 100 includes a central hub 102 centered about the axis $M_H$ and adapted to rotate about the axis $M_H$ as depicted by the arrow Φ. The central hub 102 may be cylindrical in shape but other shaped central hubs 102 also may be used.

As shown in FIG. 2, the hub assembly 100 also includes one or more radial arms 104 coupled to the central hub 102 and extending outward therefrom. Each radial arm 104 includes a proximal end attached to the central hub 102 and a distal end extending outward. The radial arms 104 may be oriented generally perpendicular to the axis $M_H$ but other orientations also may be used. In some embodiments, the radial arms 104 are attached to a lower portion of the central hub 102 leaving an upper portion 110 extending upward from the hub-arms 102-104 junction.

In some embodiments as shown in FIG. 2, the central hub 102 includes four radial arms 104 with each arm 104 oriented perpendicular with respect to its adjacent arms 104 as shown (e.g., the radial arms 104 are in a cross formation). However, it is understood that the hub 102 may include any number of radial arms 104 (e.g., 1, 2, 3, 4, 5, 6, 7, 8 or more) in any orientations as required by the assembly 10.

In some embodiments as shown in FIG. 2, the central hub 102 includes a hub opening 106. The hub opening 106 is aligned with the axis $M_H$ and extends from the top center of the hub 102 (e.g., from the top center of the hub's upper portion 110) downward through at least a portion of the hub's 102's body. The hub opening 106 may be adapted to receive a pin 108 for coupling the hub assembly 100 with a power drill. In a non-limiting embodiment, the pin 108 may be removable. The pin 108 may be held within the hub opening 106 by pressure fit, a locking pin, friction, screw threads, welding, adhesive, other attachment techniques, and any combination thereof. The upper portion 110 of the hub 102 may provide lateral support (side-to-side support) to the pin 108 engaged within the hub opening 106. Accordingly, it may be preferable that the hub opening 106 extend from the top of the upper portion 110 downward into the body of the upper portion 110 a sufficient distance to receive the pin 108 and to hold it securely therein. For example, in some embodiments, the hub opening 106 may extend about 0.5" to about 2" into the upper portion 110. In other embodiments, the pin 108 may be formed integrally with the central hub 102 and may not be removable.

In some embodiments as shown in FIG. 1, with the pin 108 inserted and secured, a portion of the pin 108 extends upward from the opening 106 so that the pin 108 may be coupled to the chuck of a power drill. In this way, the power drill may rotate the pin 108 and the hub 102 attached thereto.

Figure 3A:
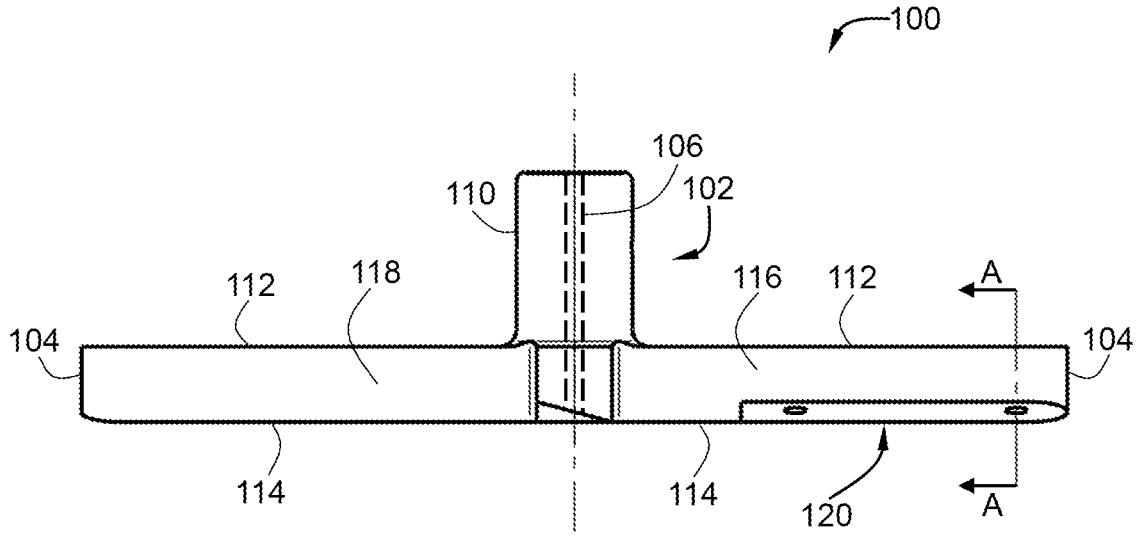
FIG. 3A shows aspects of a central hub with radial arms according to exemplary embodiments hereof.
Figure 3B:
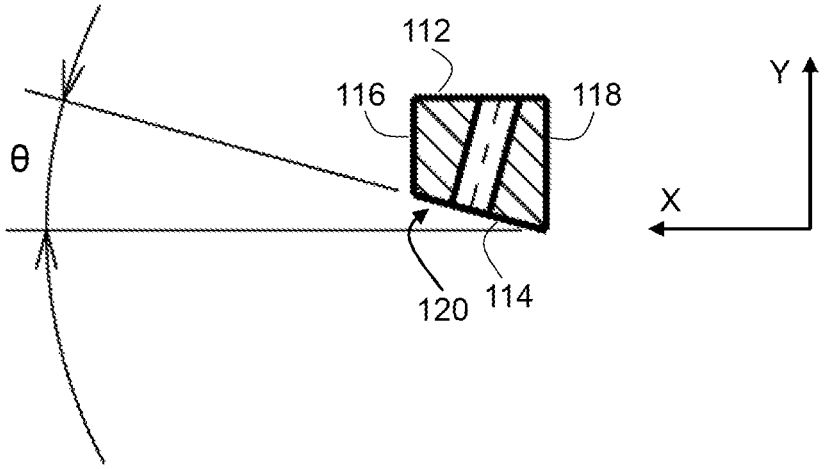
FIG. 3B shows aspects of a radial arm according to exemplary embodiments hereof.

In some embodiments as shown in FIGS. 3A-3B, each radial arm 104 includes a top 112, a bottom 114, a left side 116 and a right side 118. As will be described in other sections, elements of the blade assembly 200 (e.g., the blades) may be attached to the bottom 114 of each radial arm 102.

In some embodiments as shown in FIGS. 3A and 3B (with FIG. 3B taken from the perspective of cut lines A-A of FIG. 3A), the bottom 114 of each arm 104 includes a slanted notch 120 extending from its right side 118 to its left side 116, and from its distal end towards its proximal end. With reference to the X-Y axis shown in FIG. 3B (with the Y-axis being a vertical axis and the X-axis being a horizontal axis), the notch 120 generally extends upward at an angle θ with respect to the X-axis from the arm's 104's bottom right side 118 to the arm's 104's bottom left side 116. Example values of θ include 0° to 45°, 10° to 20°, and preferably about 15°. Given the slanted notch 120, the bottom 114 of each radial arm 104 is correspondingly slanted in the area of its notch 120. In this way, the notch 120 may provide a slanted underneath surface onto which a blade 202 (e.g., as shown in FIG. 1) may be attached, thereby securing the blade 202 at the same angle θ. This will be described in detail in other sections.

The hub assembly 100 may comprise metal (such as steel, iron, or aluminum), plastic, composite materials, any other suitable materials, and any combination thereof. The hub assembly 100 may be produced as a single piece (e.g., cast, or molded) or as separate pieces and then combined.

Blade Assembly 200

In one exemplary embodiment hereof as shown in FIGS. 1-2, the blade assembly 200 includes one or more blades 202, with each blade 202 adapted to be attached to a corresponding radial arm 104. Once configured with respective arms 104, the blades 202 may each extend radially outward from the hub 102. The blades 202 may comprise metal (e.g., steel, iron, aluminum, etc.), plastic, composite materials, other suitable materials, or any combination thereof.

Figure 4:
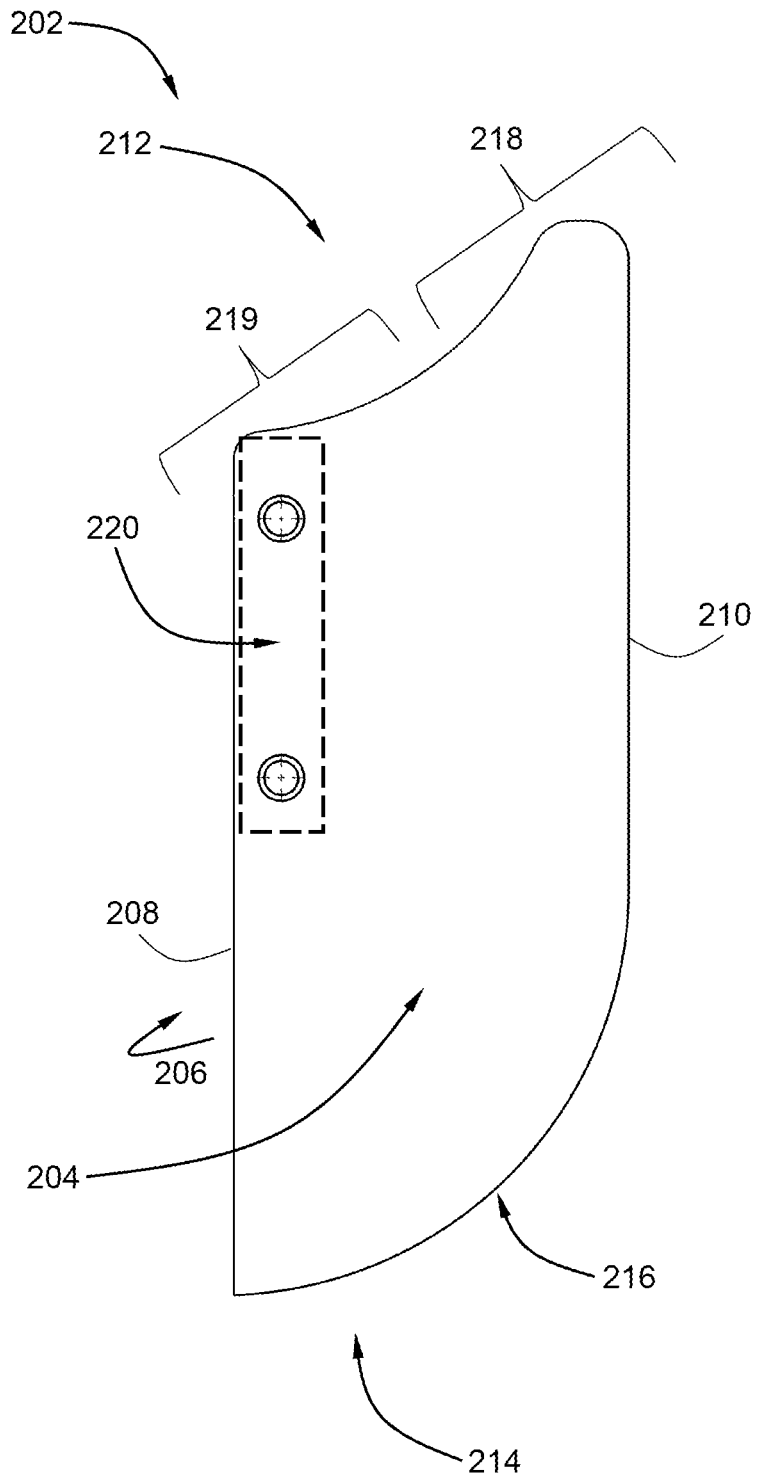
FIG. 4 show aspects of a blade according to exemplary embodiments hereof.

In some embodiments as shown in FIG. 4, each blade 202 includes a top surface 204, a bottom surface 206, a left side 208, a right side 210, a proximal portion 212 and a distal portion 214. The distal portion 214 may include a convex curvature extending from a furthermost distal end of the blade's 202's left side 208 upward and to the right (as depicted in FIG. 4) to the blade's 202's right side 210. This curvature may form the blade's working edge 216. In some embodiments, the working edge 216 may be sharpened. It is understood that other types of curvatures also may be used to form the working edge 216 (e.g., a straight curvature).

In some embodiments as shown in FIG. 4, the blade's 202's proximal portion 212 includes a foot portion 218 and an offset portion 219, with the foot portion 218 representing the furthermost proximal end of the blade 202 towards the right side 210 of the blade 202, and the offset portion 219 representing the portion of the blade's 202's proximal end to the left of the foot portion 218. As shown, the offset portion 219 is positioned towards the blade's 202's distal end compared to the blade's 202's foot portion 218. It is understood that the foot portion 218 also may include a portion of the blade's 202's right side 210 adjacent the foot portion 218, and that the offset portion 219 also may include a portion of the blade's 202's left side 208 adjacent the offset portion 219.

In some embodiments as shown in FIG. 4, the blade's 202's proximal end 212 includes a concave curvature extending from a rearmost proximal end of the blade's 202's right side 210 downward and to the left (as depicted in FIG. 4) to the blade's 202's left side 208. This curvature may generally form the blade's 202's foot portion 218 and offset portion 219. It is understood that other types of curvatures (e.g., a linear curvature) also may be used to form the foot portion 218 and the offset portion 219.

In some embodiments, each blade 202 is adapted to be attached to the bottom 114 of a corresponding radial arm 104, and in particular, onto the underneath surface of the arm 104 formed by each respective arm's 104's slanted notch 120. Accordingly, the blade 202 may include a blade attachment portion 220, as shown in FIG. 4, adapted to be attached to the notch's 120's underside surface.

Figure 5A:
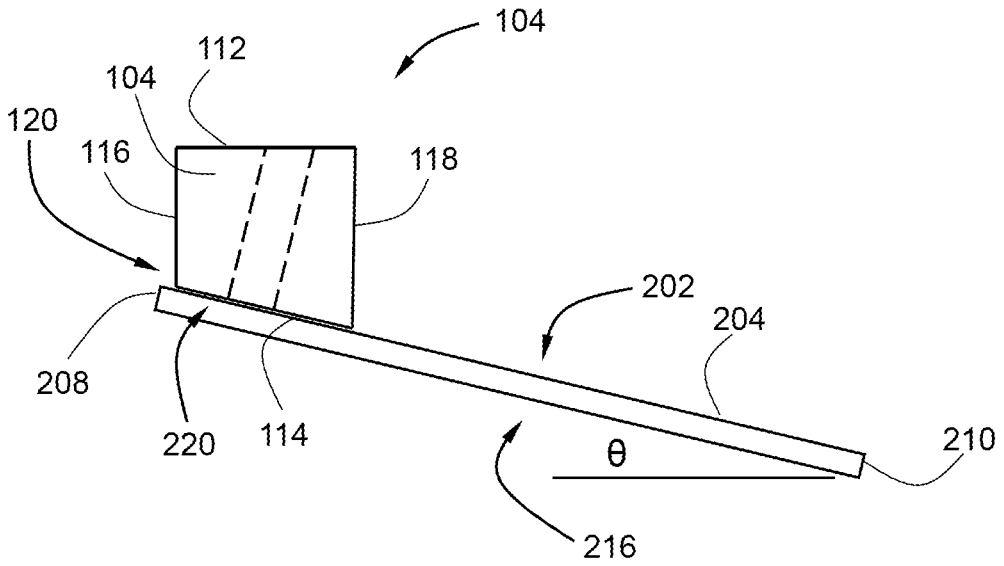
FIG. 5A shows aspects of a blade configured with a radial arm according to exemplary embodiments hereof.
Figure 5B:
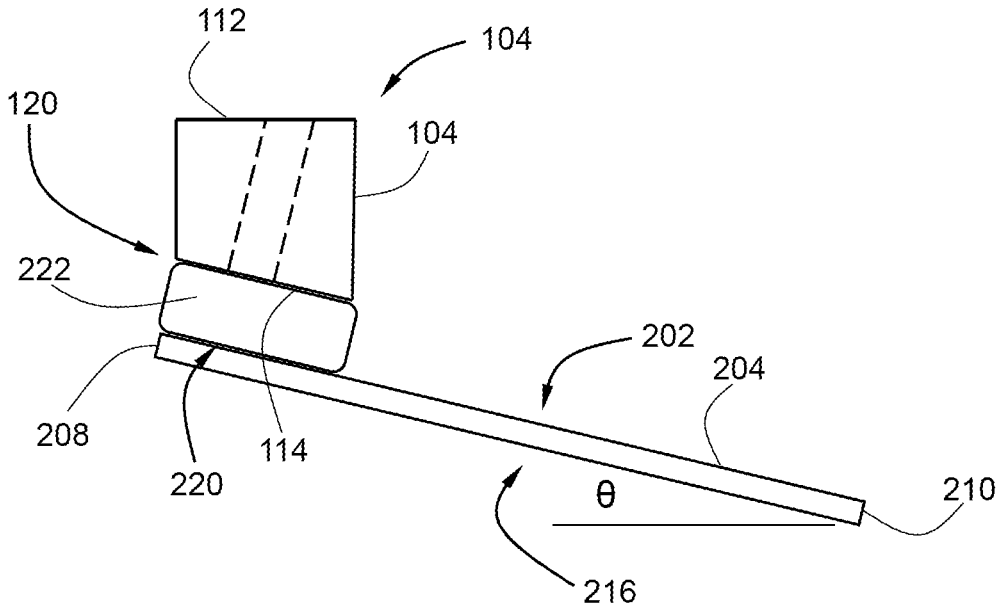
FIG. 5B shows aspects of a blade configured with a radial arm and a spacer according to exemplary embodiments hereof.

FIGS. 5A and 5B each depict a blade 202 attached to an arm's 104's underside notch 120 taken from the perspective of arrow B in FIG. 1, with FIG. 5B including an additional spacer 222 therebetween. While the blade 202 is shown to be attached to the arm's 104's underside notch 120 towards the blade's 202's left side 208, it is understood that the blade 202 may be attached to the arm 104 at any suitable location between the blade's 202's left side 208 and right side 210.

As shown, because the notch's underneath surface is set at an angle θ, the attachment of the blade 202 to the notch 120 orients the blade 202 at the same angle θ. In this configuration, the blade's 202's right side 210 is positioned lower than the blade's 202's left side 208. The radial arm 104 and the blade 202 are configured to move in a clockwise direction (as the hub 102 spins clockwise in the direction of 1 in FIG. 1) and the blade's 202's working edge 216, being angled downward, is adapted to make contact with the surface of the concrete. It is understood that if the power tool associated with the assembly 10 is instead configured to rotate counterclockwise, that the elements of the assembly 10 may be reconfigured generally opposite to the configuration described above to orient the working edge 216 (e.g., as shown in FIG. 4) of each blade 202 at the desired downward angle for proper use.

In some embodiments as shown in FIG. 5B, spacers 222 may be positioned between the notch 120 and the blade's attachment portion 220 to provide a cushioned junction between the blade 202 and the arm 104. The spacers 222 may comprise rubber, plastic, other suitable materials, and any combination thereof. It may be preferable that the spacers 222 do not alter the angular orientation of the blade 202 provided by the notch 120, but in some embodiments, the spacers 222 also may be angled to provide an additional blade 202 angular orientation. In some embodiments, the junction between a radial arm 104 and a corresponding blade 202 may include two spacers 222, but other numbers of spacers 222 also may be used.

In some embodiments, each blade 202 is attached to its respective radial arm 104 and/or spacers 222 using bolts, screws, rivets, and/or other types of pins passing through aligned openings in the radial arms 104, spacers 222 (e.g., as shown in FIG. 2) which include a central opening in one or more non-limiting embodiments) and blades 202. In other embodiments, the blades 202 may be attached to the spacers 222 and/or radial arms 104 using welding, clamps, adhesive, cement, other types of attachment mechanisms and any combination thereof. The blades 202 may be removable to be repaired (e.g., sharpened) or replaced, and/or may be permanently secured to the arms 104.

Assembly 10

Figure 6:
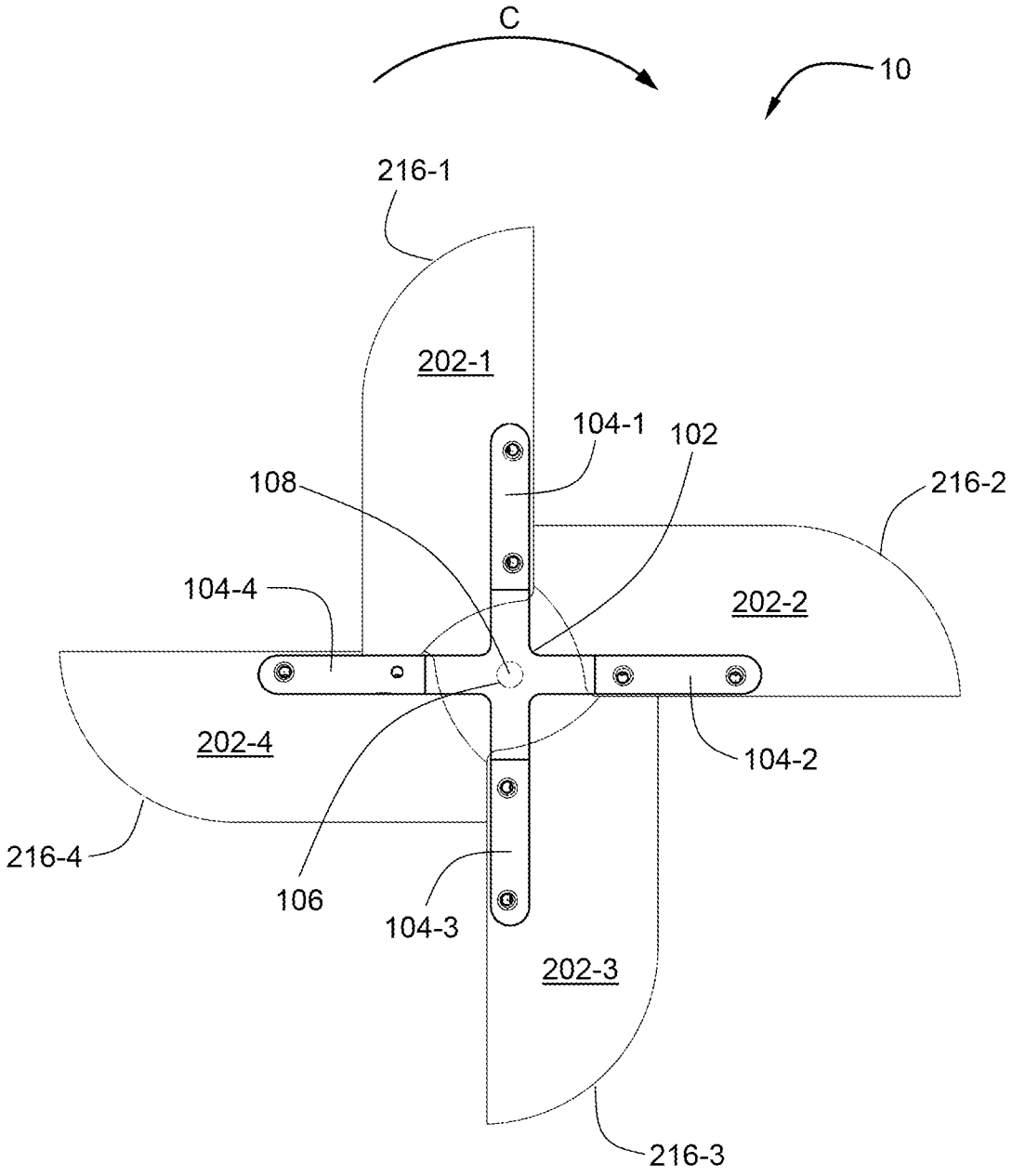
FIG. 6 shows a top view of a concrete finishing assembly according to exemplary embodiments hereof.

In one exemplary embodiment hereof as shown in FIG. 6 (showing the assembly 10 from the top), blades 202-1, 202-2, 202-3 and 202-4 are attached to corresponding radial arms 104-1, 104-2, 104-3, 104-4, respectively, such that the blades 202-1, 202-2, 202-3 and 202-4 extend outward from the central hub 102. In the configuration shown, the concrete finishing assembly 10 is adapted to be rotated clockwise as depicted by the arrow C so that the blades 202 working edges 216-1, 216-2, 216-3, 216-4 may be positioned to make contact with and thereby sweep across a surface of partially hardened concrete in a circular motion.

Figure 7:
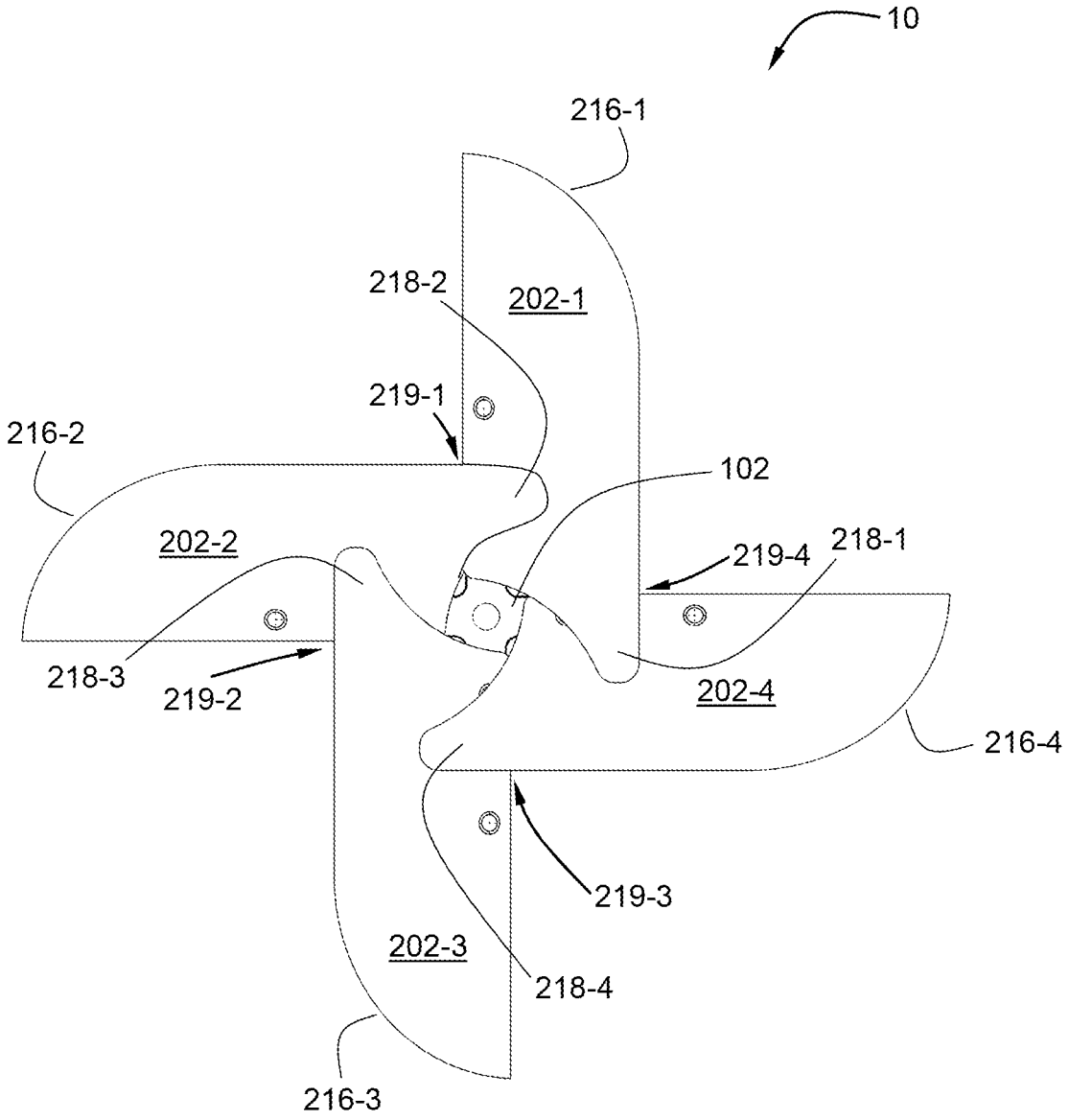
FIG. 7 shows a bottom view of a concrete finishing assembly according to exemplary embodiments hereof.

In some embodiments as shown in FIG. 7 (showing the assembly 10 from the bottom) the foot portion 218 of a blade 202 overlaps a portion of an adjacent blade's 202's offset portion 219. In some embodiments, the foot portion 218 of a blade 202 also may overlap a portion of the adjacent blade's 202's right side 210 in the area adjacent the offset portion 219.

For example, as shown in FIG. 7, the foot portion 218-1 of the first blade 202-1 may overlap a portion of the fourth blade's 202-4's offset portion 219-4, the foot portion 218-2 of the second blade 202-2 may overlap a portion of the first blade 202-1's offset portion, the foot portion 218-3 of the third blade 202-3 may overlap a portion of the second blade 202-2's offset portion 219-2, and the foot portion 218-4 of the fourth blade 202-4 may overlap a portion of the first blade 202-1's offset portion 219-1. This configuration optimizes contact continuity between the blades 202-1, 202-2, 202-3 and 202-4 and the surface of the concrete while the hub 102 and blades 202 are spinning.

In any of the embodiments described herein or otherwise, it is understood that the blades 202 may be configured with the central hub 102 using any type of architecture, junction and/or supporting members that result in the blades 202 generally extending radially from the hub 102 in the orientations as described above. For example, the proximal portion 212 of the blades 202 themselves may be attached to the central hub 102 without the use of the radial arms 104. In another example, the radial arms 104 may be integrated into the blades 202 as reinforcement structures. It is understood that the scope of the concrete finishing assembly 10 is not limited in any way by the way in which the blades 202 are configured with the hub 102 as long as the blades 202 generally extend radially from the hub 102 in the orientations as described herein.

In Use

In one exemplary embodiment hereof, the pin 108 may be coupled to the chuck of a power drill, and the power drill may be used to rotate the pin 108, the hub 102, the radial arms 104 and the blades 202 attached thereto.

With the blades rotating, the user of the assembly 10 may then place the working edges 216 of the blades 202 in contact with the surface of the partially hardened concrete to brush away surface imperfections.

The assembly 10 may be used to finish horizontal concrete surfaces, vertical concrete surfaces, angled concrete surfaces, or any combination thereof.

It is understood that the steps described above are meant for demonstration and that additional steps may be performed, not all of the described steps may be performed, and the steps may be taken in different orders. It also is understood that the scope of the assembly 10 is not limited in any way by the steps taken during its use.

It also is understood that any aspect and/or element of any embodiment of the assembly 10 described herein or otherwise may be combined with any other aspect and/or element of any other embodiment described herein or otherwise in any way to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A concrete smoothing assembly adapted to be coupled with a rotating power tool, the assembly comprising:

a central hub adapted to be coupled to the rotating power tool and including at least two outward extending arms;

a first blade attached to a first of the at least two outward extending arms, the first blade including a first blade distal portion and a first blade proximal portion, the first blade proximal portion including a first blade foot portion and a first blade offset portion; and a second blade attached to a second of the at least two outward extending arms, the second blade including a second blade distal portion and a second blade proximal portion, the second blade proximal portion including a second blade foot portion and a second blade offset portion;

wherein a portion of the first blade foot portion overlaps a portion of the second blade offset portion.

2. The concrete smoothing assembly of claim 1 further comprising:

a third blade attached to a third of the at least two outward extending arms, the third blade including a third blade distal portion and a third blade proximal portion, the third blade proximal portion including a third blade foot portion and a third blade offset portion; and a fourth blade attached to a fourth of the at least two outward extending arms, the fourth blade including a fourth blade distal portion and a fourth blade proximal portion, the fourth blade proximal portion including a fourth blade foot portion and a fourth blade offset portion;

wherein a portion of the second blade foot portion overlaps a portion of the third blade offset portion, a portion of the third blade foot portion overlaps a portion of the fourth blade offset portion, and a portion of the fourth blade foot portion overlaps a portion of the first blade offset portion.

3. The concrete smoothing assembly of claim 1 wherein at least one of the at least two outward extending arms includes a top side and a bottom side, and the bottom side includes a slanted notch, wherein at least one of the first and second blades is attached to the slanted notch.

4. The concrete smoothing assembly of claim 3 wherein the at least one of the at least two outward extending arms includes a left side and a right side, and the slanted notch extends from the right side to the left side.

5. The concrete smoothing assembly of claim 4 wherein the slanted notch extends at an angle of 10°-20° with respect to a horizontal axis.

6. The concrete smoothing assembly of claim 1 wherein at least one of the first blade and the second blade includes a left side and a right side, and a bottom side extending between the left side and the right side at an angle of 10°-20° with respect to a horizontal axis.

7. The concrete smoothing assembly of claim 1 further comprising:

a pin coupled to a top of the central hub, a portion of the pin extending upward and away from the central hub and perpendicular to the at least two outward extending arms, the pin adapted to be coupled to a rotating power tool.

8. The concrete smoothing assembly of claim 1 wherein the first blade foot portion includes a rearmost proximal portion of the first blade proximal portion.

9. The concrete smoothing assembly of claim 1 wherein the first blade foot portion and the first blade offset portion are joined by a concave curvature, and/or the second blade foot portion and the second blade offset portion are joined by a concave curvature.

10. The concrete smoothing assembly of claim 1 wherein the first blade distal portion includes a convex curvature defining a first blade working edge, and/or the second blade distal portion includes a convex curvature defining a second blade working edge.

11. The concrete smoothing assembly of claim 10 wherein the first working edge and/or the second working edge is sharpened.

* * * * *